US008480084B2

(12) United States Patent
Merkli

(10) Patent No.: US 8,480,084 B2
(45) Date of Patent: Jul. 9, 2013

(54) CONVEYING DEVICE FOR A GATHERING SECTION USED FOR FURTHER PROCESSING OF PRINTED PRODUCTS

(75) Inventor: Peter Merkli, Oftringen (CH)

(73) Assignee: Mueller Martini Holding AG, Hergiswil (CH)

( * ) Notice: Subject to any disclaimer, the term of this patent is extended or adjusted under 35 U.S.C. 154(b) by 51 days.

(21) Appl. No.: 12/412,480

(22) Filed: Mar. 27, 2009

(65) Prior Publication Data

US 2009/0243202 A1 Oct. 1, 2009

(30) Foreign Application Priority Data

Mar. 31, 2008 (EP) ..... 08405094

(51) Int. Cl.
*B65H 5/16* (2006.01)

(52) U.S. Cl.
USPC ..... 271/271; 270/52.29; 270/52.16

(58) Field of Classification Search
USPC ..... 271/243–245, 271; 270/52.16, 52.26, 270/52.29, 58.29; 198/644; 414/790.3
See application file for complete search history.

(56) References Cited

U.S. PATENT DOCUMENTS

| | | | | |
|---|---|---|---|---|
| 5,431,386 | A | 7/1995 | Blaser | |
| 6,059,093 | A * | 5/2000 | Merkli | 198/644 |
| 6,315,107 | B1 * | 11/2001 | Muller et al. | 198/606 |
| 7,281,706 | B2 * | 10/2007 | Kinne et al. | 270/52.16 |
| 7,762,538 | B2 * | 7/2010 | Kinne et al. | 270/52.29 |
| 8,113,498 | B2 * | 2/2012 | Buerge | 270/52.29 |
| 2007/0216080 | A1 * | 9/2007 | Kinne et al. | 270/52.29 |

FOREIGN PATENT DOCUMENTS

| | | | |
|---|---|---|---|
| EP | 189735 | A * | 8/1986 |
| EP | 0 881 180 | A | 12/1998 |
| EP | 1 148 011 | A | 10/2001 |
| GB | 354 963 | A | 8/1931 |
| JP | 62-105972 | | 7/1987 |
| JP | 6032508 | A | 2/1994 |
| JP | 2001072280 | A | 3/2001 |

OTHER PUBLICATIONS

European Search Report, dated Aug. 13, 2008, issued for counterpart Swiss Application No. 08405094.7-1256.
Japanese Office Action issued in Japanese Application No. 2009-081746 dated Dec. 18, 2012, mailed Jan. 22, 2013 (non-verified German and English language translations only).

* cited by examiner

*Primary Examiner* — Jeremy R Severson
(74) *Attorney, Agent, or Firm* — Venable LLP; Robert Kinberg

(57) ABSTRACT

A conveying device for a gathering section used for processing of printed products includes a plurality of saddle-shaped segments which respectively form a saddle-shaped roof for supporting the printed products during a conveying operation along a conveying path. Pusher segments are respectively arranged with the saddle-shaped segments to form a rear end stop for the conveying the printed product. Alignment segments are respectively arranged with the saddle-shaped segments to form a front end stop for a front edge of the printed products.

5 Claims, 9 Drawing Sheets

CONVEYING DEVICE FOR A GATHERING SECTION USED FOR FURTHER PROCESSING OF PRINTED PRODUCTS

CROSS-REFERENCE TO RELATED APPLICATION

This application claims the priority of European Patent Application No. 08405094.7, filed on Mar. 31, 2008, the subject matter of which is incorporated herein by reference in its entirety.

BACKGROUND OF THE INVENTION

The invention relates to a conveying device for a gathering section used for the further processing of printed products, wherein the device includes a plurality of saddle-type segments which respectively form a saddle-shaped roof for supporting printed products during a conveying operation, and wherein pusher segments respectively form a rear end stop for conveying of the printed products. Conveying devices of this type have long been known and are used for the assembling and processing of printed products, in particular printed sheets. The opened printed sheets are deposited on the conveying device, for example with the aid of feeders, and are conveyed while respectively pushed along by a pusher segment. If a plurality of such feeders are positioned along the gathering section, the printed sheets can be assembled, for example to form a brochure. The assembled printed sheets can then be stitched together, for example in a processing station.

The problem with conveying devices of this type has long been that with high conveying speeds, the transport of the printed sheets can be interrupted as a result of the sheets bouncing back from the pusher or fluttering up. This interruption in particular restricts the conveying speed and thus the output of this type of conveying device and/or gathering section, especially if the printed sheets are made of comparably thin paper.

European patent document EP-A-0 881 180 discloses a conveying device with pushers that are inclined forward in the running direction. These pushers are embodied to resemble upward-pointing fingers and are intended to favorably influence the impact behavior of the printed sheets when the sheets are deposited on the conveying device and/or the gathering chain. In particular, this embodiment of the angled and upward pointing pushers is designed to redirect an upward bounding, fluttering printed product back onto the conveying device.

SUMMARY OF THE INVENTION

It is an object of the present invention to provide a conveying device of the aforementioned type, which more reliably avoids the aforementioned problems and makes it possible to operate at higher conveying speeds.

The above and other objects are achieved according to the invention wherein there is provided, according to one embodiment, a conveying device for a gathering section used for processing of printed products, comprising: a plurality of saddle-shaped segments which respectively form a saddle-shaped roof for supporting the printed products during a conveying operation along a conveying path; pusher segments respectively arranged with the saddle-shaped segments to form a rear end stop for conveying the printed product; and alignment segments respectively arranged with the saddle-shaped segments to form a front end stop for a front edge of the printed products.

According to another embodiment, the conveying device comprises at least one conveying element provided with the pusher segments and an additional conveying element provided with the alignment segments. The modified conveying device according to the invention may comprise at least two conveying elements, wherein one conveying element is provided with pushers referenced to the back edge of the sheet and the other conveying element is provided with alignment segments referenced to the front edge of the same printed sheet. By correspondingly adjusting the two conveying elements, relative to each other, the spacing between a pusher and the associated alignment segment can be adapted to the format of the printed sheet to be conveyed. This modification is advantageous with respect to the structural design, as well as the production costs.

According to a further embodiment of the invention, the alignment segments respectively comprise at least one movable alignment part, which has the essential advantage that the alignment parts can be pivoted between at least two positions. In particular, the alignment parts can respectively be pivoted to a pull-back position at a predetermined location along the gathering section, so that they do not obstruct the depositing of the printed product on the conveying device. Once the printed product has been deposited on the conveying device, the respective alignment segment can be moved to the position in which it forms a referenced end stop for the front edge of the printed product.

The movement of the alignment parts may be controlled with the aid of an upright control element, for example a cam or a control cam. For the adaptation to different formats, the at least one control element may be adjustable in a longitudinal direction of the gathering section. The individual alignment parts may be activated at a lower end. The aforementioned at least one control element in this case may be arranged below the conveying element that is provided with the alignment segments. If an alignment segment or an alignment part is located at the level of the aforementioned control element, then the alignment part is controlled accordingly. For this, the alignment parts may include two-arm levers. In particular, the alignment parts may be pivoted when they engage in the aforementioned stationary control element. The aforementioned at least one control element may be spring-loaded, for example, so that the alignment parts may be respectively moved forward as well as backward. For example, the control element may be positioned or spring-positioned so that it can evade in a downward direction during a return movement.

A different embodiment of the invention provides that the alignment segments may be respectively provided with a holding-down device to hold down the printed products deposited on the conveying device. With the aid of the holding-down device, it is possible to effectively prevent a fluttering up of the printed sheets as a result of the slipstream or air flow. According to a further embodiment of the invention, the holding-down devices may be arranged so such that they extend counter to the conveying direction. In the operating or active position, these holding-down devices may be positioned above the printed product to be conveyed and, in particular, directly above a fold on the printed product, wherein the printed products in this case may be folded sheets or signatures. The aforementioned holding-down device can be shaped similar to an ear, but in particular and may be roof-shaped and embodied so as to be arranged on the left and right, relative to a vertical plane of symmetry. However, an asymmetric arrangement is conceivable as well.

The conveying device in particular may comprise a gathering chain and especially an open-link chain, but that is not required. The conveying device can furthermore be embodied as toothed belt conveyor, belt conveyor, and/or cable type conveyor. In particular, the conveying device may be endless and fitted around a drive wheel as well as a guide wheel, with a standard design being used for the drive.

According to another embodiment of the invention, a stationary ridge or a ridge that moves along can be provided, on which the printed products can be transported such that they straddle the ridge. In combination with the aforementioned alignment segments, a ridge of this type can ensure a particularly secure guidance of the printed products as well as an especially high production capacity.

If the conveying device is provided with two or more conveying elements, these may be guided or move parallel, relative to each other, and also with synchronized speed. These conveying elements are advantageously guided in the front and/or in the back over concentric guide wheels, which can either be chain wheels, toothed belt pulleys, or the like.

BRIEF DESCRIPTION OF THE DRAWINGS

These and other features and advantages of the invention will be further understood from the following detailed description of the embodiments of the invention with reference to the accompanying drawings.

DETAILED DESCRIPTION

Figure 1:
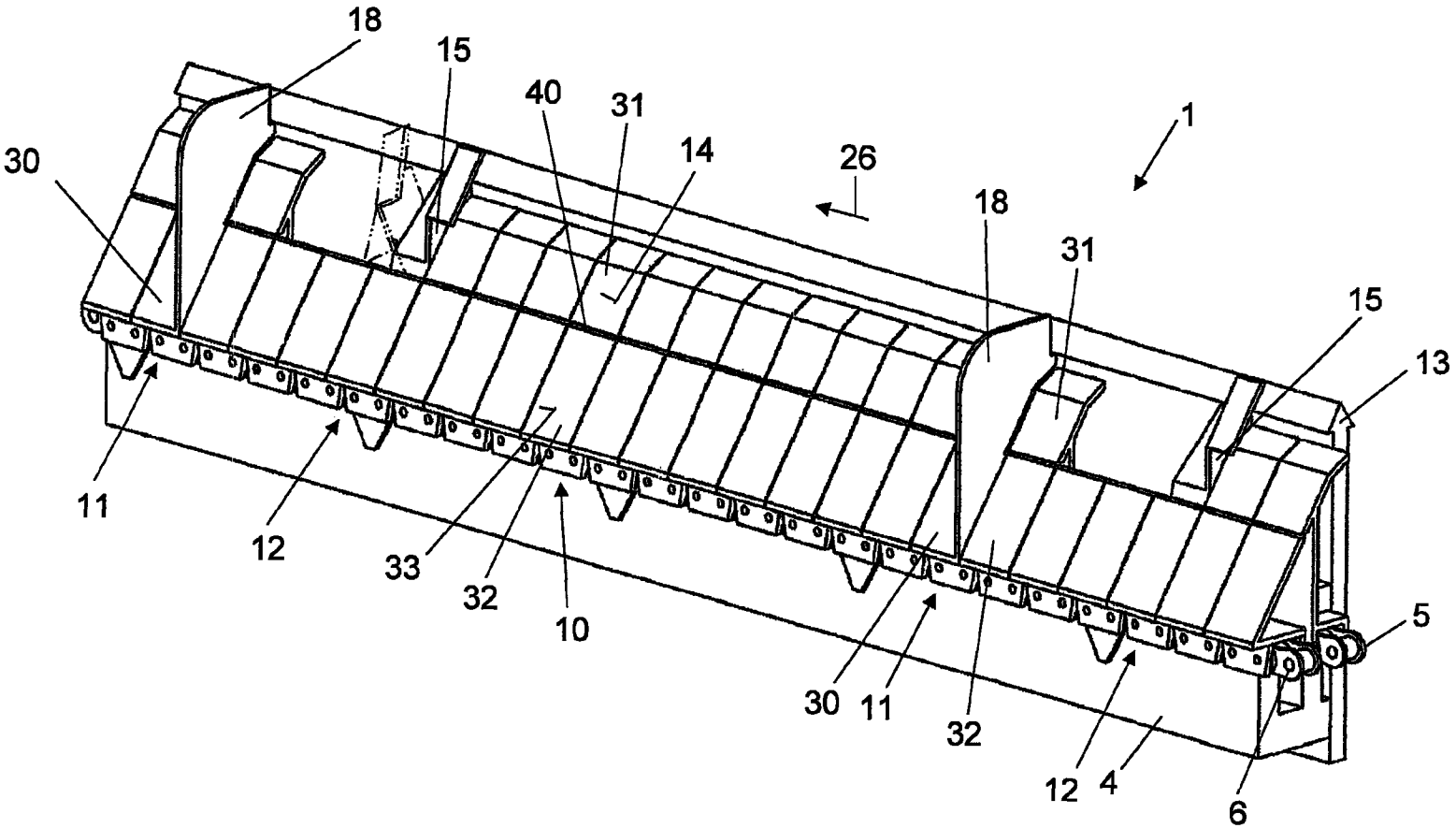
FIG. 1 is a three-dimensional partial view of a section of the conveying device according to the invention.
Figure 2:
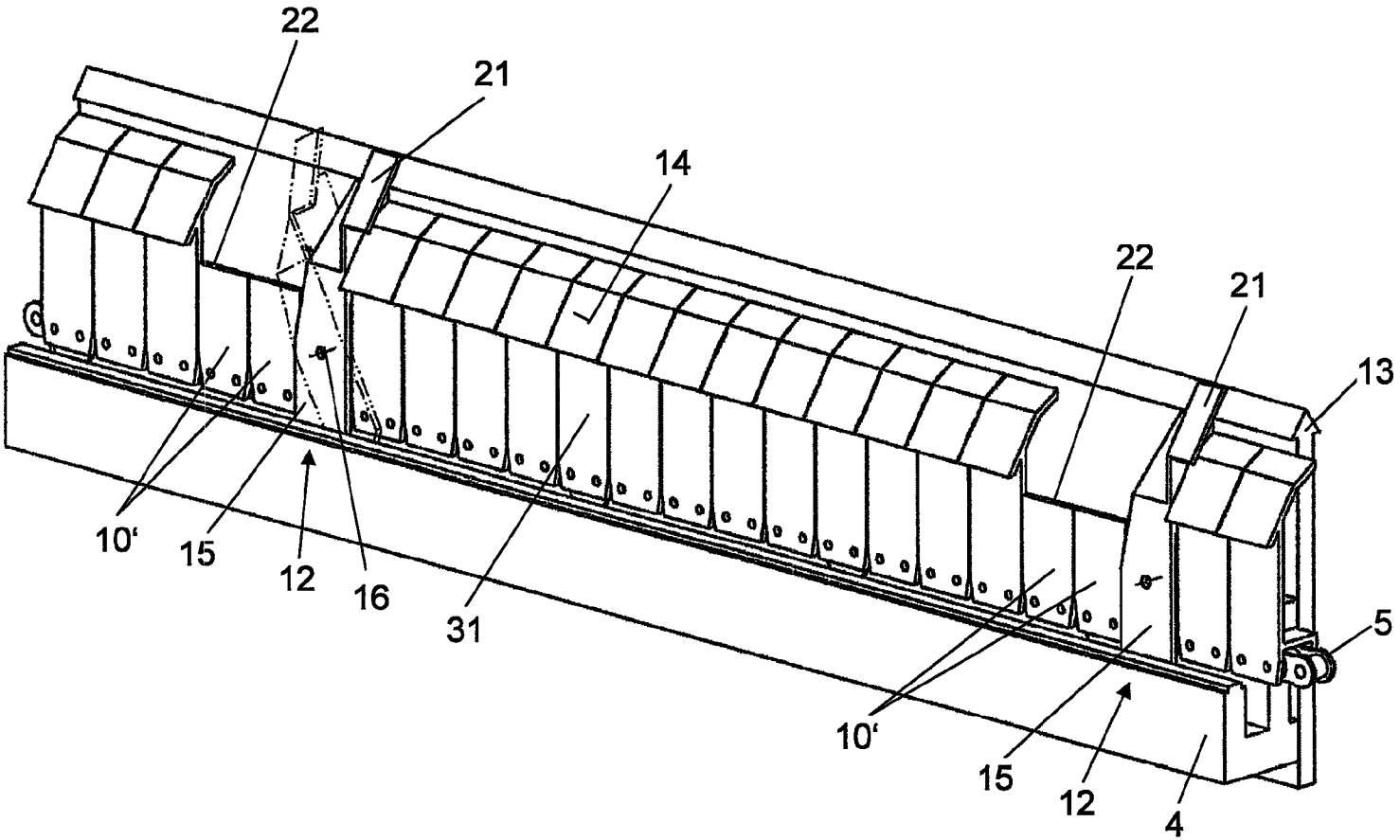
FIG. 2 is a view of the section shown in FIG. 1, wherein the pushers are omitted.
Figure 3:
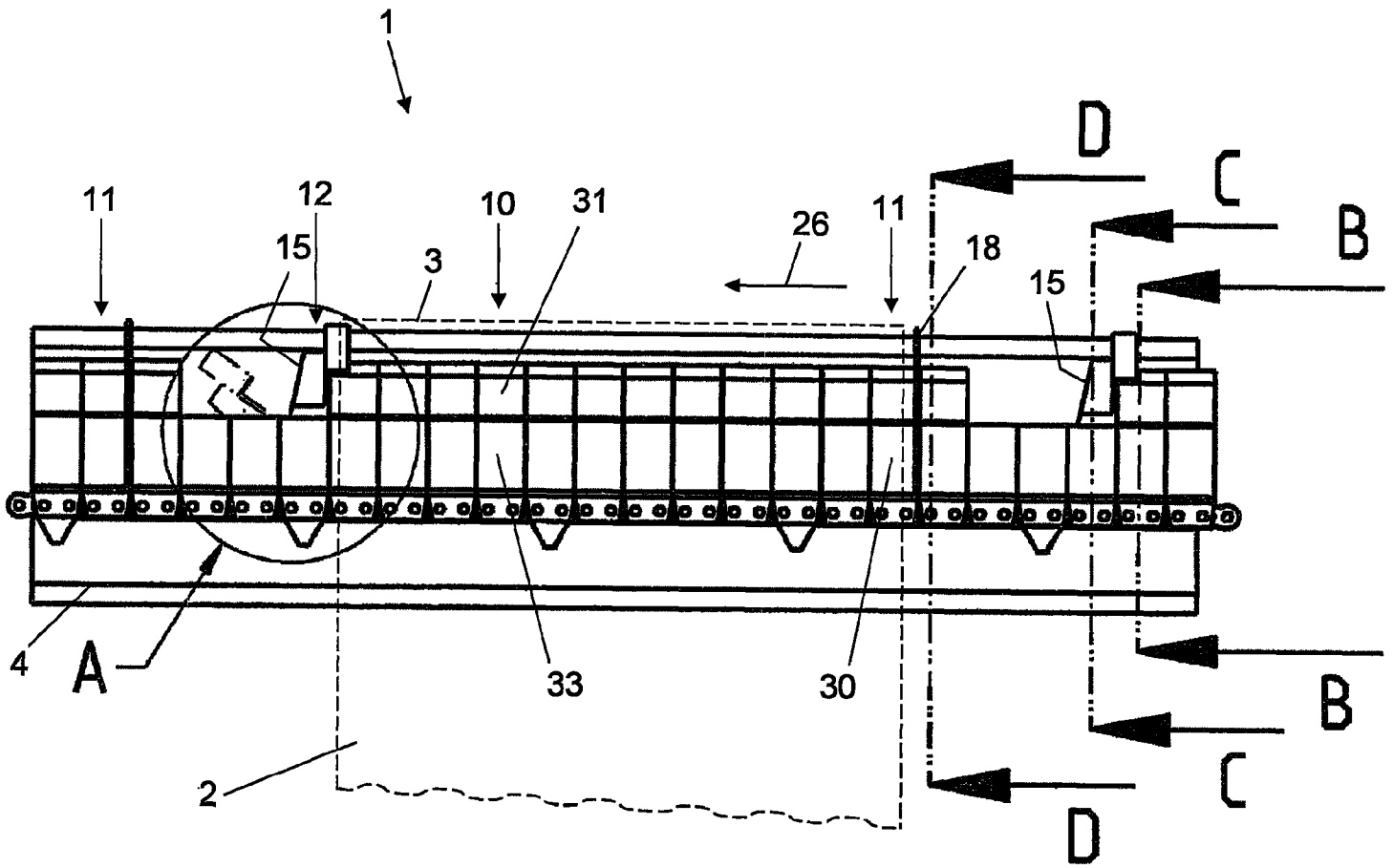
FIG. 3 is a different view of a section of the conveying device according to the invention.

Referring to the figures, there is shown in FIG. 1 a portion of an upper run of a conveying device 1 on which printed products 2 are conveyed in the direction of arrow 26. The printed products 2 (see FIG. 3) in particular are folded sheets or signatures with a fold 3 that extends in a longitudinal direction of a ridge 13 during a conveying operation. The printed products 2 may be deposited in a known manner on the conveying device 1, for example with the aid of a feeder that is not shown herein. The speed of the conveying device 1 in this case may be synchronized with that of the feeder. The conveying device 1 may be driven, for example by fitting it around chain wheels that are not shown herein. In general, a plurality of feeders may be provided for gathering the printed products 2 and/or the signatures along the upper run of the conveying device 1, in a manner known per se.

Figure 7:
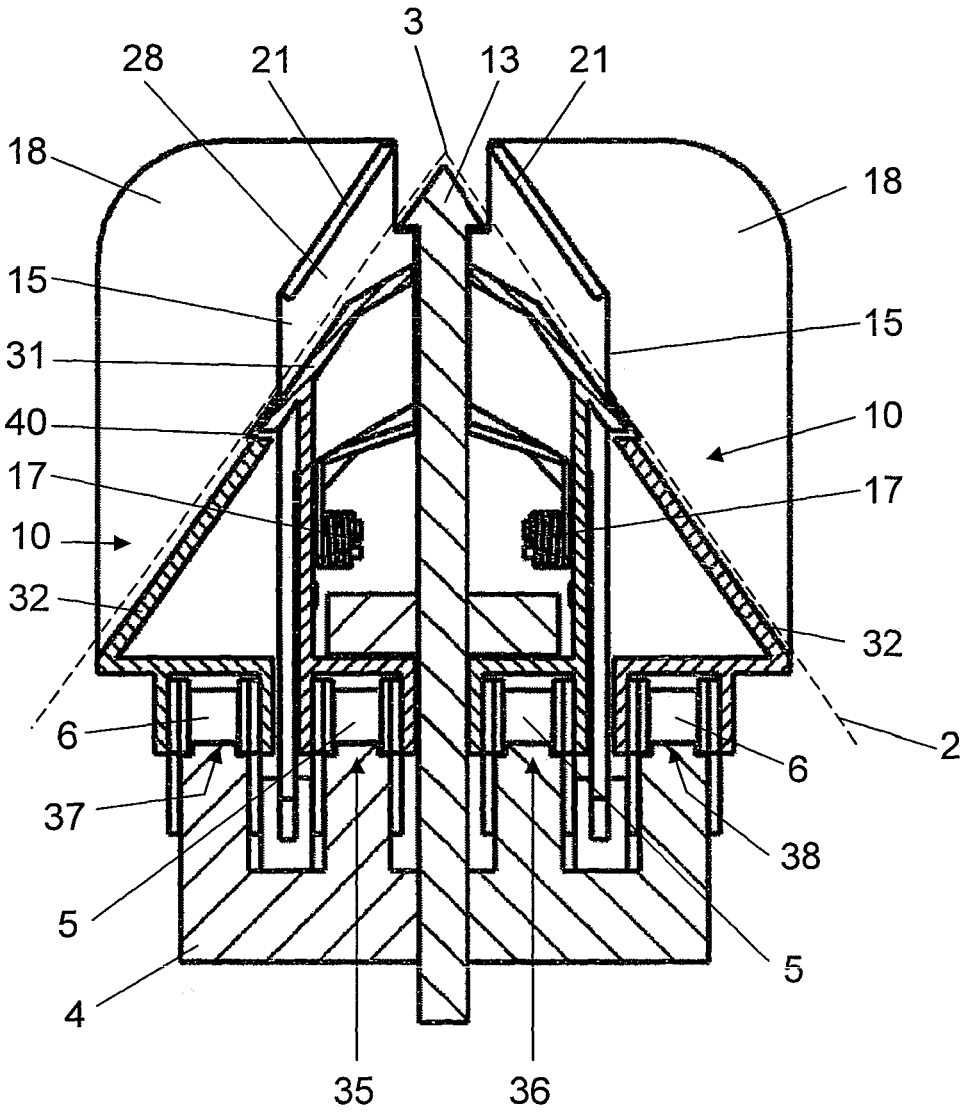
FIG. 7 is a section through the conveying device according to the invention, along the line B-B in FIG. 3.

The printed products 2 are pushed along by respectively two pushers 18, which may be arranged as shown in FIG. 7 to the left and to the right of the ridge 13, and which project on the sides in the manner of wings. Referring to FIGS. 1 and 7, each pusher 18 may be mounted on a support 30 that is fitted onto a pull chain 6, which is guided by a guide rail 4. The two pushers 18 and the two supports 30 jointly form a pusher segment 11. The conveying device 1 comprises a plurality of such pusher segments 11, wherein these are respectively positioned uniformly spaced apart.

Figure 5C:
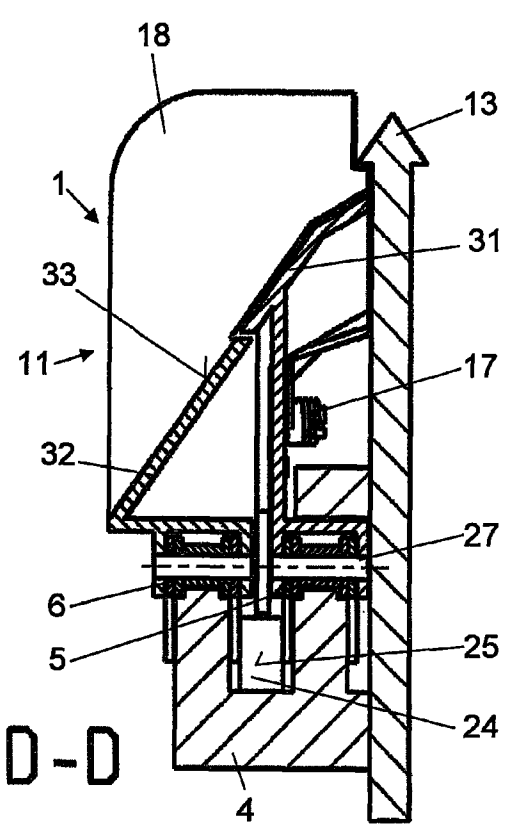
FIGS. 5*a*-5*c* are sectional views along the lines B-B, C-C and/or D-D in FIG. 3, wherein respectively only the ridge and the left portion of the conveying device are shown.
Figure 5B:
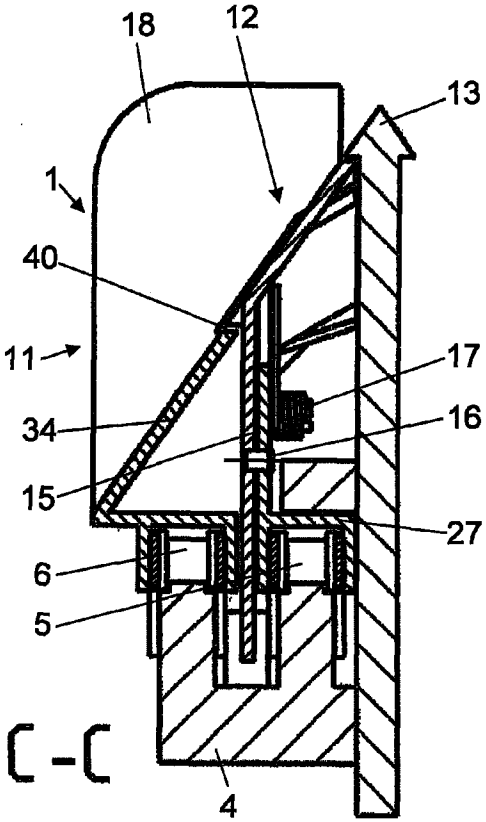
Figure 5A:
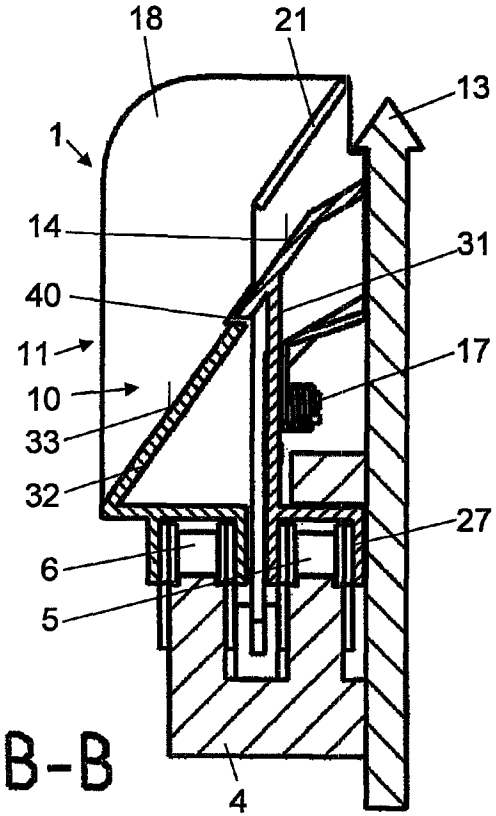

Arranged between respectively two pusher segments 11 are saddle-shaped segments 10, respectively provided with two supports 31 and two supports 32, of which only one is respectively shown in FIG. 5*a*. The supports 31 and 32 each have a roof-shaped area 14 and/or 33, against which the conveyed printed products 2 come to rest. As compared to the area 14, the area 33 is slightly offset toward the center of the conveying device 1, thereby preventing that the opened printed products 2 that are supplied from above to the conveying device 1 are caught inside a gap 40, formed by the two supports 31 and 32. The supports 31 are each fitted onto the pull chain 5 and the supports 32 are fitted onto the pull chain 6, for example by snapping them on.

Figure 4:
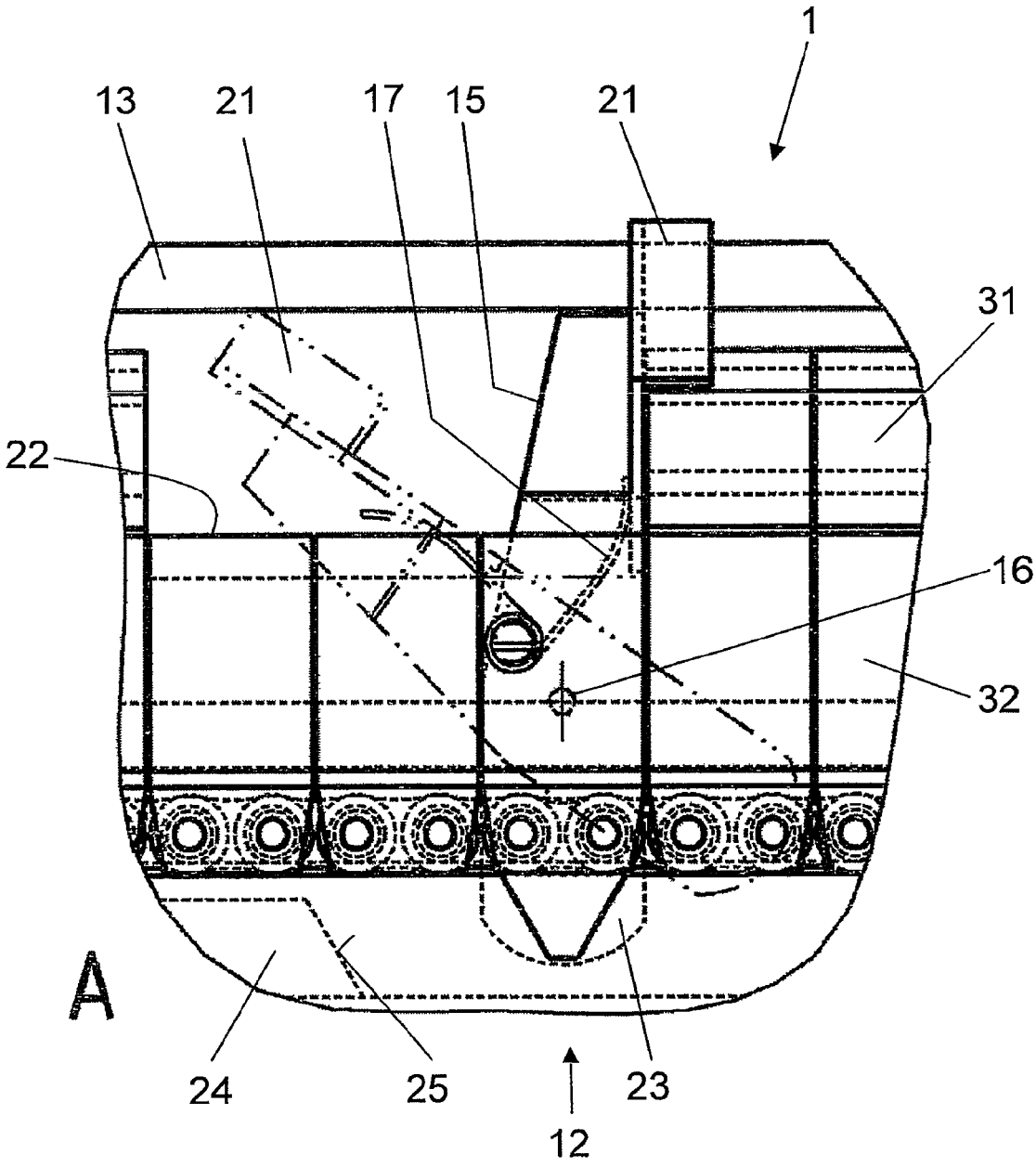
FIG. 4 is a partial view of the conveying device according to the invention, in accordance with detail A of FIG. 3.
Figure 6A:
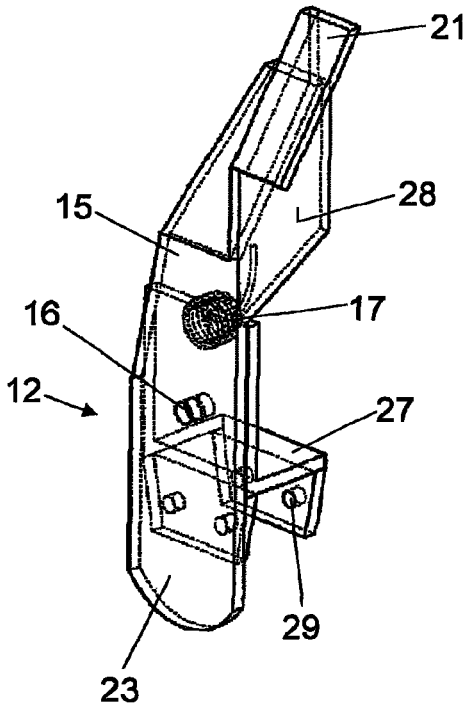
FIGS. 6*a*-6*b* are three-dimensional views of a portion of the alignment segment.
Figure 6B:
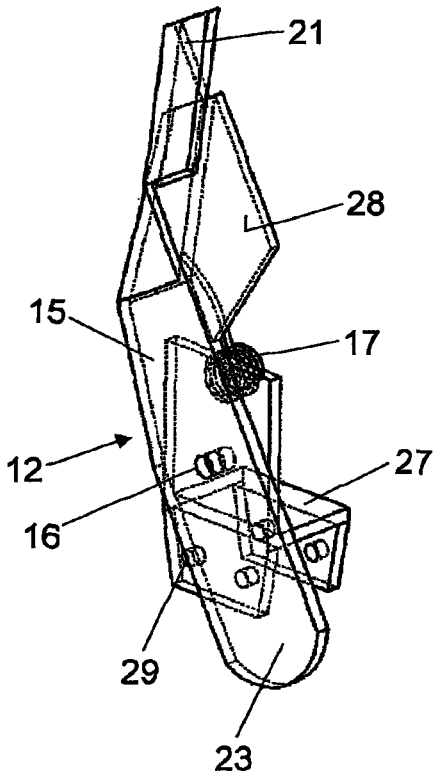

The conveying device 1 also comprises uniformly spaced-apart alignment segments 12, respectively arranged at a specific distance to a pusher segment 11. Each alignment segment 12 is provided with a support 34 and an alignment part 15, wherein these parts may be positioned symmetrical relative to the ridge 13 also as shown in FIG. 7. The individual alignment parts 15 may be movably attached to pivot on a support 27, as shown in FIG. 5*b*. As seen in cross section, the supports 27 are shaped approximately like a chair and are each mounted on the pull chain 5. The alignment parts 15 may be respectively connected via a pivoting axis 16 to one of the supports 27. The intended pivoting movement is limited and is shown in FIGS. 6*a* and 6*b*. FIG. 6*a* shows one of the pivoting positions, the active or operating position. In the second position, shown in FIG. 6*b*, the alignment segment 12 is inactive. This position is respectively shown with dash-dot lines in FIGS. 1 to 4.

According to FIGS. 6*a* and 6*b*, respectively one spring element 17 keeps the alignment parts 15 in the position shown in FIG. 6*a*. The spring elements 17 may be spiral springs made from a spring steel wire and respectively positioned on the support 27. The respective alignment part 15 can be moved counter to the force of the spring element 17 from the position shown in FIG. 6*a* to the pivoted position shown in FIG. 6*b*. These two positions are defined, for example, by end stops that are not shown herein.

The individual alignment parts 15 are provided with a holding-down device 21, which extends in the manner of a roof approximately parallel and at a distance over the surface 14, as shown in FIG. 5*a*. According to FIG. 5*a*, the holding-down device 21 extends upward to approximately above the ridge 13, wherein a space and/or a gap is left between this ridge 13 and the holding-down device 21. Respectively two holding-down devices 21 of an alignment segment 12 are arranged symmetrical to a ridge 13, as shown in FIG. 7. However, it is also conceivable to have an asymmetrical design for the holding-down devices 21, with respect to the ridge 13.

As shown in FIGS. 6*a* and 6*b*, the holding-down devices 21 respectively project at a right angle over an end stop surface 28. The two end stop surfaces 28 are provided as end stops and/or as alignment surfaces for the front edge of the individual printed product 2, but only if the two respective alignment parts 15 are in the active or operating position as shown in FIG. 6*a*. If a printed product 2 is positioned on the conveying device 1, a pusher segment 11 forms an end stop for the rear edge while an opposite-arranged alignment segment 12 forms an end stop for the front edge. The respective printed product 2 is thus referenced to the back edge by a pusher segment 11 and to the front edge by an alignment segment 12. As a result, the movement of the printed product 2 is prevented or severely limited in the longitudinal direction of the conveying device 1. In addition, the holding-down devices 21 for the respective alignment segment 12 prevent the front edge of the printed product 2 from being lifted upward and off the conveying device 1, for example as a result of the slip stream. The holding-down devices 21 consequently function to stop an upward movement that must be prevented.

Before a printed product 2 is deposited on the conveying device 1, the alignment part 15 that is arranged upstream of the pusher segment 11, as seen in conveying direction, is pivoted to a position where it cannot interfere with the depositing of the printed product 2. FIG. 4, for example, illustrates the pivoting of the alignment part 15 into this position. The dash-dot lines in FIG. 4 show the position in which the holding-down devices 21 are pivoted to a lower and thus inactive position, wherein the pivoting to this position is controlled and occurs at a predetermined location. According to FIG. 4, a control mechanism may comprise a control element 24 with a control surface 25 and/or a control cam. The control element 24 may be arranged such that it cooperates with a cam 23 and/or a lower end of the alignment part 15 once this alignment part 15 reaches the control surface 25. If the alignment part 15 along with the cam 23 runs up onto the control element 24, then the alignment part 15 is pivoted counterclockwise around the pivoting axis 16 and, in the process, the spring element 17 is tensioned. The spring element 17 moves the alignment part 15 immediately back to the active position, as soon as the cam 23 disengages from the control element 24.

The control element 24 is fixedly mounted in a frame, which may be displaced for adjusting it to different formats. The control element 24 is preferably embodied displaceable, such that it can be moved in a downward direction during the return movement of the conveying device. During this return movement, the cam 23 can thus deflect the control element 24 in downward direction. Several such control elements 24 can be arranged along the gathering section. The positions are determined such that the alignment parts 15 are respectively pivoted at the correct moment to the inactive position and, as soon as the respective printed product 2 has been deposited, are pivoted back once more to the active position.

In order to pivot the alignment part 15 to the position shown with dash-dot lines in FIG. 1, two special saddle-shaped segments 10' are arranged in place of the saddle-shaped segments 10 downstream of the alignment part 15, as seen in the conveying direction. The saddle-shaped segments have a gap 22 (see FIGS. 2 and 4) into which the holding-down device 21 may be submerged.

Figure 8:
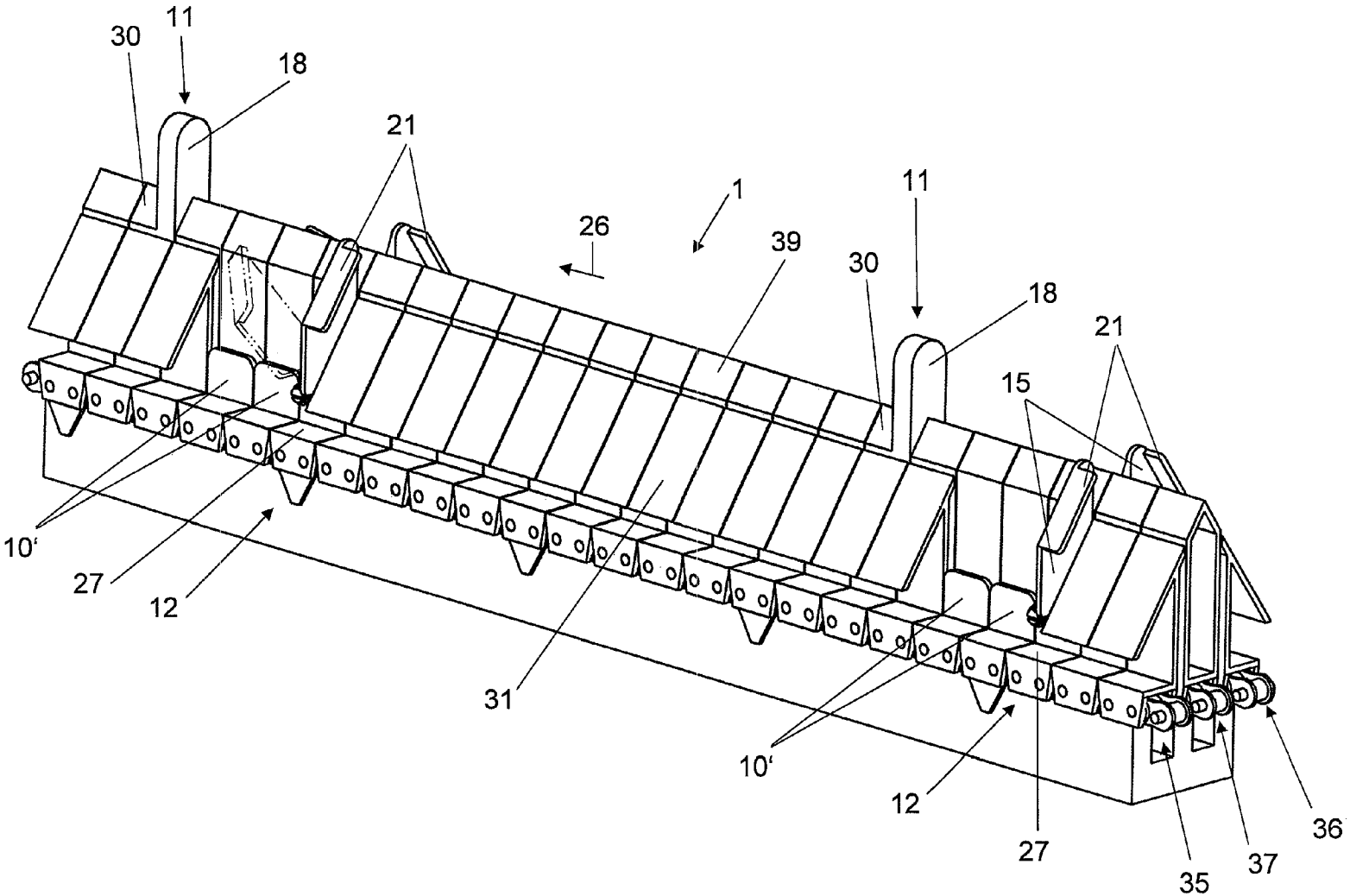
FIG. 8 is a three-dimensional partial view of a variant of the conveying device according to the invention.
Figure 9:
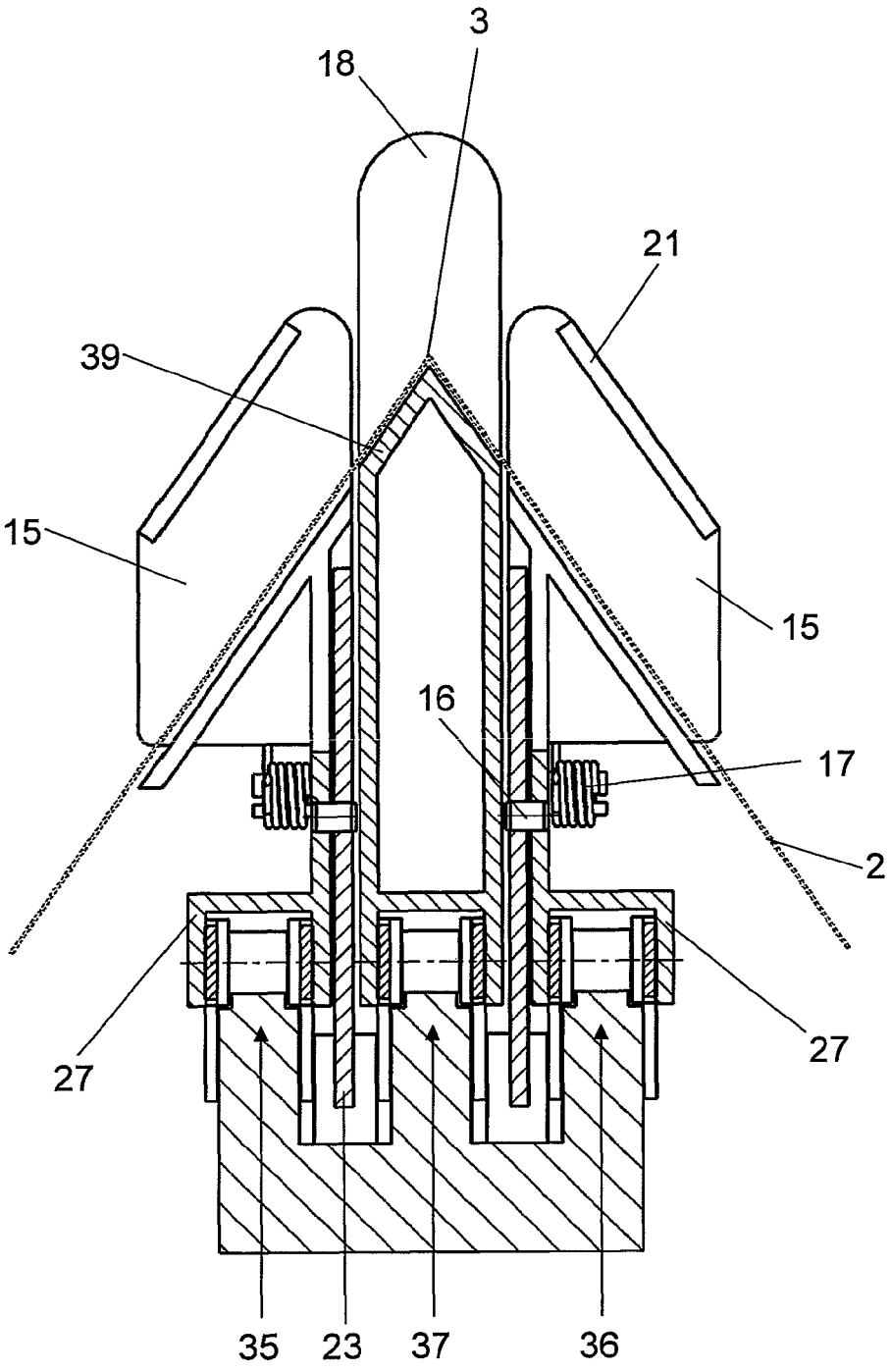
FIG. 9 is a section through the conveying device according to the invention as shown in FIG. 8.

The conveying device 1 may comprises a plurality of conveying elements, shown in FIG. 7, as two inside conveying elements 35 and 36 and two outside conveying elements 37 and 38. The inside conveying elements 35 and 36 may be driven with the two pull chains 5 while the outside conveying elements 37 and 38 may be driven with the two pull chains 6. The pushers 18 may be components of the outside conveying elements 37 and 38 and the alignment parts 15 may be components of the two inside conveying elements 35 and 36. Since the conveying elements 37 and 38, as well as the conveying elements 35 and 36, can be adjusted independently, the distances between the pusher segments 11 and the alignment segments 12 can be adjusted for adapting to different formats of the printed products 2. The conveying elements 35 to 38 respectively move with synchronized speed and parallel to each other. The conveying elements 35 to 38 and/or the pull chains 5 and 6 may be guided around concentric, identically dimensioned crawler-chain wheels that are not shown herein. The following variations are possible for arranging the conveying elements 35 to 38. The conveying elements 35 and 36 may be arranged on the outside and the conveying elements 37 and 38 may be arranged on the inside. In that case, the pushers 18 would be located on the inside and the alignment parts 15 on the outside. Also possible would be an asymmetric arrangement for which a conveying element provided with the pushers 18 would be arranged on the left side of the ridge 13 and a conveying element provided with the alignment parts 15 would be arranged on the opposite side. Furthermore conceivable would be an embodiment with three conveying elements. As shown in FIGS. 8 and 9, two saddle-shaped segments 10 may be connected to respectively one conveying element 35, 36. Ridge sections 39, which are components of the conveying element 37, may be arranged between the saddle-shaped segments 10. A pusher segment 11 may be inserted at regular intervals in place of a ridge section 39. With this type of embodiment, the printed products may be pushed along by only one pusher 18. For the embodiment with 3 conveying elements as shown in FIGS. 8 and 9, the stationary ridge 13 that is shown in FIGS. 1 to 5 and 7, which centers the printed products 2 along the fold 3 during the conveying operation, may be replaced by the ridge sections 39 that move along. In principle, an embodiment provided with only one or two conveying elements would also be conceivable. In that case, an adaptation to different formats may be realized with the aid of a corresponding displacement of the pushers 18 and/or the alignment parts 15.

The ridge 13 can be fixedly installed inside a frame or can be designed to move along, wherein it is also possible to have an embodiment without a ridge 13. The pull chains 5 and 6 are preferably open-link chains. However, the pull chains 5 and 6 can in principle also be replaced with other endless traction members such as toothed belts, belts, or cables. The pushers 18 are shown in the Figures as wings that project to the side, but can also have a different design. An embodiment would be conceivable where the pushers are embodied as upward-pointing fingers, for example as disclosed in European patent document EP 0 881 180A. The alignment parts 15 can also have different designs. The holding-down devices 21 are useful, but are not required. The alignment parts 15 for the above-described example may be pivoted. However, alignment parts 15 of this type can in principle also be moved differently, e.g. they may be moved in a vertical direction. An embodiment is furthermore conceivable in principle for which the alignment parts 15 and/or the alignment segments 12 are immovable.

It will be understood that the above description of the present invention is susceptible to various modifications, changes and adaptations, and the same are intended to be comprehended within the meaning and range of equivalents of the appended claims.

What is claimed is:

1. A conveying device for a gathering section used for processing of printed products, comprising:

a plurality of saddle-shaped segments which respectively form a saddle-shaped roof for supporting the printed products during a conveying operation along a conveying path;

a plurality of pusher segments respectively arranged with the saddle-shaped segments, wherein each pusher segment forms a rear end stop for a rear edge of a respective printed product for conveying the printed product along the conveying path in a conveying direction; and a plurality of alignment segments respectively arranged with the saddle-shaped segments, wherein each alignment segment is arranged at a distance from a respective pusher segment to form a front end stop for a front edge of the respective printed product, wherein each of the alignment segments comprises at least one alignment part movable relative to the saddle-shaped segments between an active position and an inactive position, wherein each alignment part is respectively controlled to move to the active position at a predetermined location along the conveying path to limit movement of the respective printed product parallel to the conveying direction, wherein each alignment part is respectively controlled to move to an inactive position at a different predetermined location along the conveying path to allow depositing of the respective printed product on the saddle-shaped segment, and wherein the pusher segments and the alignment segments are movable relative to each other to adjust to different formats for the printed products.

2. A conveying device for a gathering section used for processing of printed products, comprising:

a plurality of saddle-shaped segments which respectively form a saddle-shaped roof for supporting the printed products during a conveying operation along a conveying path;

a plurality of pusher segments respectively arranged with the saddle-shaped segments, wherein each pusher segment forms a rear end stop for a rear edge of a respective printed product for conveying the printed product along the conveying path in a conveying direction;

a plurality of alignment segments respectively arranged with the saddle-shaped segments, wherein each alignment segment is arranged at a distance from a respective pusher segment to form a front end stop for a front edge of the respective printed product, wherein each of the alignment segments comprises at least one alignment part movable relative to the saddle-shaped segments between an active position and an inactive position, wherein each alignment part is respectively controlled to move to the active position at a predetermined location along the conveying path to limit movement of the respective printed product parallel to the conveying direction, and wherein each alignment part is respectively controlled to move to an inactive position at a different predetermined location along the conveying path to allow depositing of the respective printed product on the saddle-shaped segment; and a control element to control movement of the alignment parts between the active and inactive positions, wherein the control element is adapted to permit the alignment parts to be moved forward and backward.

3. A conveying device for a gathering section used for processing of printed products, comprising:

a plurality of saddle-shaped segments which respectively form a saddle-shaped roof for supporting the printed products during a conveying operation along a conveying path;

a plurality of pusher segments respectively arranged with the saddle-shaped segments, wherein each pusher segment forms a rear end stop for a rear edge of a respective printed product for conveying the printed product along the conveying path in a conveying direction; and a plurality of alignment segments respectively arranged with the saddle-shaped segments, wherein each alignment segment is arranged at a distance from a respective pusher segment to form a front end stop for a front edge of the respective printed product, wherein each of the alignment segments comprises at least one alignment part movable relative to the saddle-shaped segments between an active position and an inactive position, wherein each alignment part is respectively controlled to move to the active position at a predetermined location along the conveying path to limit movement of the respective printed product parallel to the conveying direction, and wherein each alignment part is respectively controlled to move to an inactive position at a different predetermined location along the conveying path to allow depositing of the respective printed product on the saddle-shaped segment, wherein each alignment part includes a holding-down device arranged to hold down the respective printed product deposited on the conveying device.

4. The conveying device according to claim 3, wherein the holding-down device is arranged to extend above the front edge of the printed product in the active position.

5. A conveying device for a gathering section used for processing of printed products, comprising:

a plurality of saddle-shaped segments which respectively form a saddle-shaped roof for supporting the printed products during a conveying operation along a conveying path;

a plurality of pusher segments respectively arranged with the saddle-shaped segments, wherein each pusher segment forms a rear end stop for a rear edge of a respective printed product for conveying the printed product along the conveying path in a conveying direction; and a plurality of alignment segments respectively arranged with the saddle-shaped segments, wherein each alignment segment is arranged at a distance from a respective pusher segment to form a front end stop for a front edge of the respective printed product, wherein each of the alignment segments comprises at least one alignment part movable relative to the saddle-shaped segments between an active position and an inactive position, wherein each alignment part is respectively controlled to move to the active position at a predetermined location along the conveying path to limit movement of the respective printed product parallel to the conveying direction, and wherein each alignment part is respectively controlled to move to an inactive position at a different predetermined location along the conveying path to allow depositing of the respective printed product on the saddle-shaped segment, wherein the saddle-shaped roof presents a ridge, and the pusher segments are arranged on one side of the ridge and the alignment segments are arranged on the other side of the ridge.

* * * * *